United States Patent [19]

Ferluga

[11] 4,028,994

[45] June 14, 1977

[54] MICRO-PRECISION TIMED FIRING HANDGUN

[76] Inventor: Benjamin A. Ferluga, 3814 Leavenworth Road, Kansas City, Kans. 66104

[22] Filed: Oct. 29, 1975

[21] Appl. No.: 626,980

[52] U.S. Cl. ..... 89/161; 42/10

[51] Int. Cl.[2] ..... F41C 5/02

[58] Field of Search ..... 42/10, 11; 89/160, 161, 89/180, 191 A, 42 B

[56] References Cited

UNITED STATES PATENTS

| | | | |
|---|---|---|---|
| 726,399 | 4/1903 | Burgess | 89/161 X |
| 839,911 | 1/1907 | Wesson | 42/11 X |
| 886,211 | 4/1908 | Hino et al. | 42/11 X |
| 2,397,572 | 4/1946 | Weaver | 42/10 |
| R11,800 | 1/1900 | Wesson | 42/11 UX |

FOREIGN PATENTS OR APPLICATIONS

| | | | |
|---|---|---|---|
| 71,712 | 2/1943 | Czechoslovakia | 89/191 A |

*Primary Examiner*—David H. Brown
*Attorney, Agent, or Firm*—Schmidt, Johnson, Hovey & Williams

[57] ABSTRACT

A handgun of the drop barrel type has an over-length firing pin coupled with a "pile-driving" barrel action that permits the firing of rifle load cartridges. A micro-precision timing sequence of the action causes the rearwardly propelled cartridge disposed in the floating drop barrel chamber to strike the fixed firing pin while the barrel is still in its rearwardly moving direction. In the preferred form of the invention a spring driven actuator sleeve surrounding the barrel interiorly of a receiver tube propels the barrel rearwardly such that the cartridge is ignited and the bullet discharges from the barrel prior to the seating of the barrel against a breech plate that is integral with the gun frame. Gases escaping and expanding from the cartridge are captured by the barrel and actuator sleeve and cooperate with the inertia created by the falling barrel to lock and seal the barrel chamber against the breech plate. After the firing sequence is completed with the bullet leaving the barrel the pressure drops to near zero and a second spring pulls the barrel forward, the actuator sleeve having already been returned to its cocked condition by the expanding gases. Structure is also disclosed which may be used to utilize expanding gases from a discharging shell in equalizing the pressure on the cartridge and a specially configured firing pin is also disclosed to aid in the ejection of a spent cartridge. A second form of the handgun has a barrel that is hand actuated as opposed to a normal trigger assembly and a third form of the invention has a trigger operated action but does not provide for the utilization of the gases from the discharged cartridge in recocking the firearm.

14 Claims, 10 Drawing Figures

MICRO-PRECISION TIMED FIRING HANDGUN

This invention relates to a handgun of the kind that utilizes what is known as a floating drop barrel in which the barrel of the firearm shifts longitudinally relative to its frame. Even more specifically, this invention relates to a drop barrel type gun in which at least certain components of the action respond operatively to the gases generated by a discharging cartridge. While firearms of this general type have been known for years, they share a common disadvantage with other types of handguns in that they are rather limited with respect to the powder load they can safely handle. In other words, handguns could not safely be used with cartridges having, for example, a load placing it in the full rifle shell class. That is to say, again by way of example, that a .32 caliber handgun can safely handle a cartridge having a load generating up to no more than 26,000 psi upon discharge while a corresponding .32/20 Winchester rifle can operate with cartridge loads running in the 55,000 psi range.

It is therefore a very important object of my invention to provide a handgun capable of safely discharging cartridges having loads placing them in the same pressure and bullet velocity class as equivalent rifle load cartridges of the same caliber.

It is yet a further very important object of the instant invention to provide a drop barrel action handgun having a micro-precision cartridge ignition capability that enables the bullet from the cartridge to exit the barrel before the barrel seats against its breech plate.

As a corollary with the foregoing object, it is a further aim of my invention to provide a drop barrel action handgun in which the inertia of the rearwardly moving barrel is combined with the expanding gases from a discharging cartridge to effectively control the high pressures created at the time of discharge.

A still further important object of my invention is to provide a handgun constructed to safely confine and direct the discharge of the gases from a cartridge in a manner to utilize the pressures generated upon discharge in retaining the barrel firmly seated against the breech block until the pressure in the barrel has been safely lowered and the gases dissipated.

Another very important object of the invention is to provide a handgun having an action in which the cartridge is propelled in the direction of a firing pin in such a manner that, when a bottle neck shell is used, the primer powder therein is not caused to jam at the neck portion of the shell at the time of firing but is rather disposed rearwardly thereof permitting even burning around the mass and thereby reduce the pressures built up in the cartridge during discharge.

A still further significant object of my invention is to provide a handgun in which a portion of the pressure created by a discharging cartridge is utilized to equalize the forces exerted on a cartridge shell to minimize distortion thereof at the time of discharge.

Another object of the invention is to provide a handgun having a firing pin so constructed to cause the primer cap of a discharging cartridge to collapse thereabout in order that the cartridge might be retained on the firing pin for subsequent discharge by an ejector.

Figures 1, 2, 3, 9, 10:
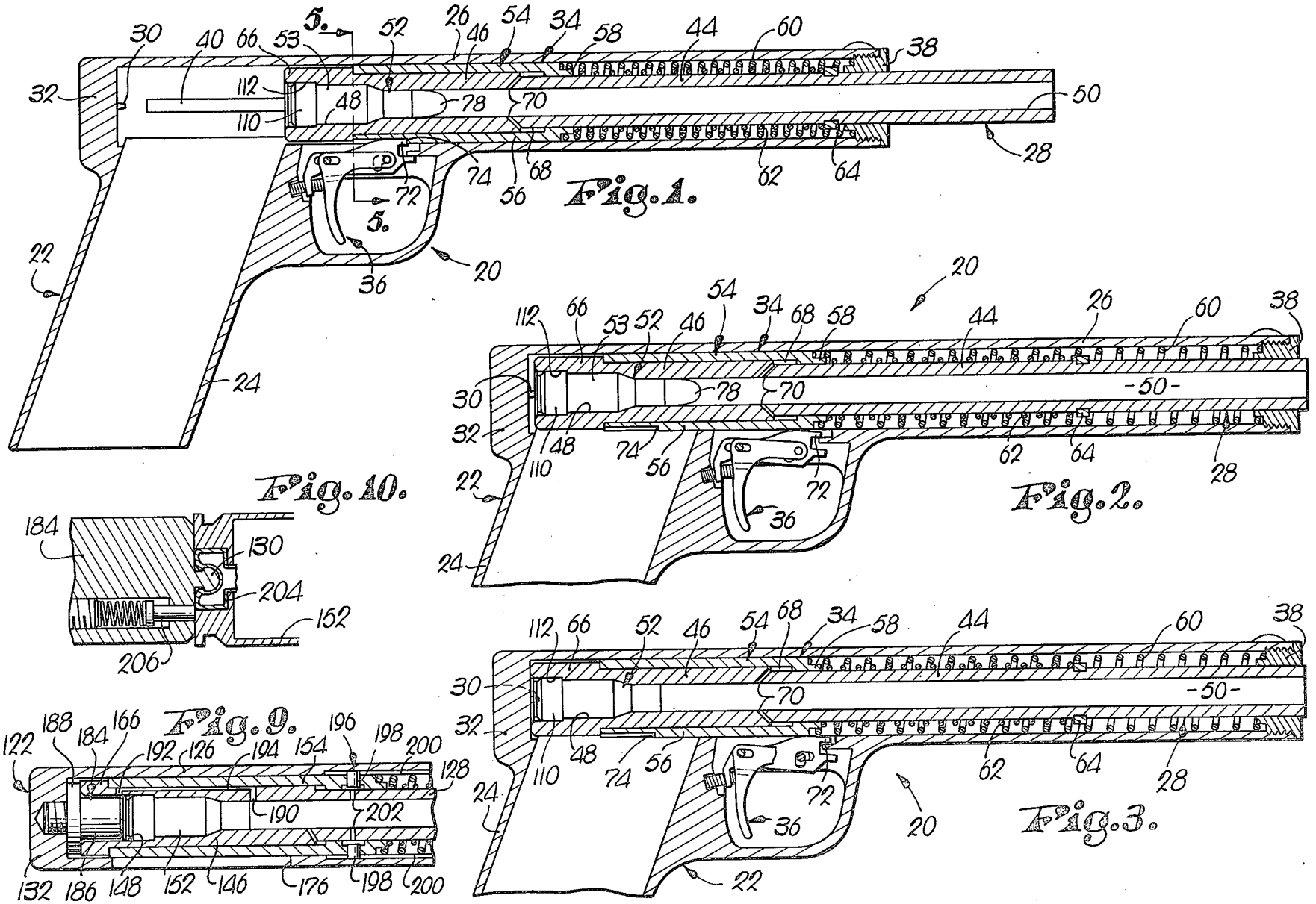
FIG. 1 is a vertical, longitudinal cross-sectional view of a handgun made pursuant to the present invention with the barrel and actuating mechanism therefor shown in a cocked condition and a cartridge disposed in the barrel chamber.
FIG. 2 is a fragmentary, cross-sectional view similar to that of FIG. 1 illustrating the disposition of the barrel and its actuating mechanism at the precise moment the cartridge engages the firing pin and is discharged subsequent to actuation of the trigger assembly.
FIG. 3 is a fragmentary, cross-sectional view similar to FIG. 1 and 2 illustrating the disposition of the barrel and its actuator sleeve after the barrel has seated against its breech plate and the bullet has been discharged from the barrel.

FIG. 9 is a fragmentary, horizontal cross-sectional view illustrating an alternate construction in which the firing pin and its support are telescopically received within a recessed cartridge chamber of the barrel and also illustrating a floating brake arrangement for the actuator sleeve as well as a passageway for equalizing the pressure on the cartridge shell upon discharge; and FIG. 10 is an enlarged, fragmentary cross-sectional view illustrating a modified firing pin having a ball-nosed configuration and showing a discharged cartridge in which the primer cap has been collapsed around the firing pin.

The following U.S. Pats. comprise the most pertinent prior art known to the inventor:

| | | |
|---|---|---|
| 581,296 | Mannlicher | April 27, 1897 |
| 666,084 | Burgess | January 15, 1901 |
| 726,399 | Burgess | April 28, 1903 |
| 2,397,572 | Weaver | April 2, 1946 |
| 2,705,847 | Kramer | April 12, 1955 |
| 2,931,039 | Henning et al | April 5, 1960 |
| 3,757,447 | Rowe | September 11, 1973 |
| 3,849,924 | Whitlinger | November 26, 1974 |

Referring initially to FIGS. 1–6, a preferred form of the invention is illustrated wherein a drop barrel handgun, broadly identified by the numeral 20, is generally comprised of a frame 22 having a handgrip 24 and an elongate tube 26 integrally constructed with the handgrip 24 and extending forwardly therefrom at the upper end thereof; an elongate barrel 28 operably disposed for axial reciprocation therealong; a fixed firing pin 30 projecting axially into the tube 26 and located at the closed rearwardmost end of the tube 26 which defines a breech plate 32; and a barrel actuating mechanism, generally defined by the numeral 34, which includes a trigger assembly 36. Materials used in construction of the handgun 20 may be those used in conventional handgun construction such as for example chrome vanadium steel.

The barrel 28 is comprised generally of two basic portions; an elongate stem portion 44 and an enlarged rear portion 46 having an increased wall thickness to define a cartridge chamber 48 at the rearwardmost end of a central bore 50. It is to be here understood that while the drawings illustrate the cartridge chamber having a bottle neck configuration to receive a corresponding bottle-neck cartridge 52, the barrel 28 could be constructed to receive other types of cartridges such as those having straight, rimmed or rimless center fire cases.

Considering now the barrel actuator mechanism 34, there is provided, in addition to the trigger assembly 36, a cylindrical sleeve member 54 disposed within the tube 26 for axial reciprocation therealong and through which the barrel 28 extends in telescopic relationship therewith. A main body 56 of the sleeve member 54 is of a size to slidably receive the enlarged rear portion 46 of the barrel 28 and terminates at its forward end in a reduced neck section 58 having an inner diameter corresponding closely with the outer diameter of the stem portion 44 of the barrel 28 for sliding action longitudinally therealong. Thus, in viewing the Figures, it will be seen that the open ended sleeve member 54 circumferentially surrounds the barrel 28 interiorally of the tube 26 and serves as a guide therefor.

Figures 4, 5, 6, 7, 8:
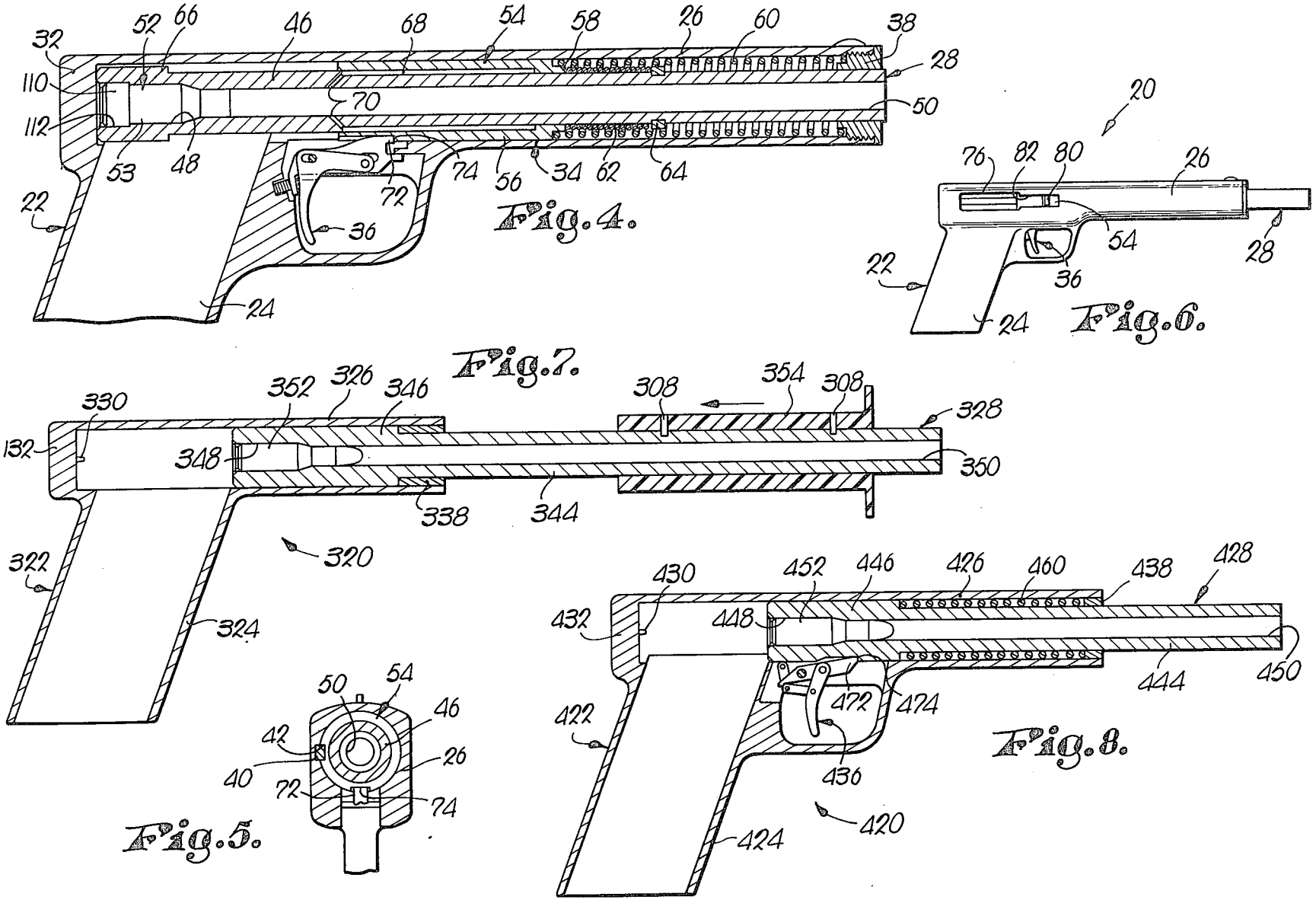
FIG. 4 is a fragmentary, cross-sectional view similar to FIGS. 1–3 illustrating the actuator sleeve returned to its forward, cocked position in response to the expanding gases from the discharged cartridge.
FIG. 5 is a cross-sectional view taken along line 5—5 of FIG. 1.
FIG. 6 is a side view, on a reduced scale, of the handgun in its cocked condition.
FIG. 7 is a vertical, longitudinal cross-sectional view of a modified form of the handgun constructed as a hand operated survival gun.
FIG. 8 is a vertical, longitudinal cross-sectional view of a third form of the invention illustrating a modified form of the barrel actuator mechanism.

The barrel 28 is maintained in its proper disposition within the cylindrical tube 26 by a forward annular guide 38 threadably received by the tube 26 at its distal end and an elongate key 40 disposed longitudinally along the inner wall surface of the tube 26 adjacent its rearwardmost end. A key way 42 machined in the outer wall surface of the sleeve body 56 serves as a guide for actuator sleeve 54 as is best shown in FIG. 5.

Also forming an integral part of the actuating mechanism 34 is a compression spring 60 disposed longitudinally along and over the stem portion 44 of the barrel 28 interiorally of the tube 26. This spring 60 is interposed between the forward guide 38 and the body 56 of the sleeve 54 and is of a sufficiently large diameter to be disposed closely adjacent the inner wall surface of the tube 26. A second compression spring 62 is also longitudinally disposed along the barrel 28 between the first mentioned spring 60 and the stem portion 44. This spring 62 is of a somewhat shorter length and smaller diameter and is interposed between the reduced neck portion 58 of the sleeve 54 and an annular stop 64 suitably secured to the outer surface of the barrel stem 44 at a location thereon such that the stop 64 is located adjacent the retainer 38 when the barrel is in a cocked condition as illustrated in FIG. 1.

Integrally formed at the rearwardmost end of the rear portion 46 of the barrel 28 is a circumferential ring 66 which defines an annular abutment against which the rearwardmost end of the sleeve member 54 is seated. In this connection, it is to be noted that the specific relative location of the abutment ring 66 with respect to the respective lengths of the rear portion 46 and body 56 of the sleeve 54 in such that when the sleeve 54 is in abutting engagement with the ring 66 the body 56 extends slightly beyond the enlarged portion 46 such that an annular cavity 68 is presented along the stem 44 intermediate the reduced neck section 58 and the enlarged rear portion 46 of the barrel 28.

Located in the wall of the barrel 28 generally in that area where the enlarged rear portion 46 terminates in the stem portion 44 is at least a pair of conduits 70 which serve to place the bore 50 of the barrel 28 in communication with the cavity 68. Normally there would be from two to six of these forwardly angled conduits 70 spaced circumferentially around the barrel 28, the number of conduits depending upon the size and caliber of the handgun.

Particular note is to be made also of the specific, predetermined length of the firing pin 30. Certain standards have been established for firing pin lengths depending on a given caliber firearm. This length ranges from 0.025 to 0.055 inches. The length of the subject firing pin 30 ranges from 0.080 to 0.110 inches depending on the type of cartridge, powder, bullet weight, caliber and length of barrel. For example and by way of illustration, presume that a handgun constructed in accordance with this invention is designed to handle the equivalent of a .32/20 caliber Winchester rifle bottle neck cartridge. In this instance the barrel would have a length of approximately 12 inches and the firing pin would ideally be 0.095 inches for a cartridge having 18 grains of Hercules 2400 fast burn powder and a bullet weight of 100 grains.

The trigger assembly 36 may be of any suitable type such as that illustrated and forms no part of the subject invention. Suffice it to say that any trigger assembly 36 providing a sear 72 operably shiftable into and out of engagement with a notch 74 located in the outer wall surface of the body 54 immediately above the trigger assembly 36 will be adequate. The specific structural details of the trigger assembly 36 will, of course, depend upon whether the handgun 20 is a single shot, an automatic or a semi-automatic. Such trigger assemblies are well known in the art and need not be further described herein.

Turning now to the operation of the handgun 20, let it be presumed that the same is in its loaded and cocked condition as illustrated in FIG. 1. In such a condition, the barrel 28 and actuator sleeve member 54 are located in their normal, forward positions spaced ahead of the breech plate 32 and firing pin 30. The barrel 28 and sleeve member 54 are held in this condition against the bias of the spring 60 which is in a compressed state between the retainer 38 and the body 56. Attention is also directed to the fact that while the spring 60 is in a compressed state the second spring 62 is not compressed but is rather in a normal, uncompressed condition. The barrel 28 and sleeve member 54 are thus held in this cocked condition by the sear 74 which is in its raised position to engage the notch 74 of the sleeve member 54.

An opening 76 (FIG. 6) in the side of the frame tube 26 just ahead of the breech plate 32 and above the grip 24 affords access to the chamber 48 for the insertion of the cartridge 52. While no cartridge clip or other type of cartridge feeding mechanism in shown it is to be understood that the handgun 20 may be equipped to receive such devices.

Actuation of the trigger assembly 36 causes the sear 72 to be withdrawn from the notch 74 at which time the bias of the compressed spring 60 urges the actuator sleeve 54 rearwardly and in so doing, acts as a pile-driver to propel the barrel 28 with the cartridge 52 therein toward the firing pin 30 by virtue of the abutting engagement of the sleeve body 56 with the barrel ring 66. During the firing of the gun it must be recognized that the sequence of events herein described occur with split second timing.

When the barrel 28 along with its actuator sleeve 54 reaches the position shown in FIG. 2, the primer cap (not shown) of the cartridge 52 is driven against the overlength firing pin 30 to ignite the powder therein at which time the gas pressures therein build up. With the release of a bullet 78 gases escaping from the cartridge are directed into the cavity 68 via the conduits 70. Thus, during this precise instant as the bullet is travelling along the bore 50 and the barrel 28 is still in its rearward motion the gases expanding in the cavity 68 are cooperating with the inertia of the falling barrel to firmly seat the barrel 28 in a second position against the breech plate 32 as shown in FIG. 3. It is to be understood that the bullet 78 has exited the bore 50 just immediately prior to the seating of the barrel 28 against the breech plate 30.

As soon as the barrel seats, the continued expansion of the gases in the cavity 68 urges the sleeve member 54 in an opposite direction to return it to its original cocked condition as shown in FIG. 4. In so returning the sleeve member 54 to its original condition, the spring 60 has been recompressed while the barrel return spring 62 has now been compressed because of the decreased span between the stop 64 and the neck portion 58 of the actuator sleeve 54. As soon as the gases from the discharging cartridge 52 have dissipated the reduced pressure in the enlarged cavity 68 is not sufficient to withstand the bias of the spring 62 at which time the barrel 28 is then pulled forwardly by the action of the spring 62 to its first position in which the rear portion 46 is again received in the body 56 of the sleeve 54 with the rearwardmost end thereof in abutment with the barrel ring 66 as originally shown in FIG. 1.

It is the precisely timed sequence of events, beginning with the ignition of a cartridge while located in rearwardly moving the barrel, that permits the use of cartridge loads in the rifle range that operate at pressures in excess of 50,000 psi. A conventional .32 caliber handgun operates in the area of 26,000 psi with occasional extreme pressures reaching 40,000 psi maximum. A .32 caliber handgun constructed in accordance with the present invention could take a superload cartridge having 2½loads of fast burning powder and safely operate at a pressure of approximately 60,000 psi pressure. By way of comparison a conventional load .32 caliber cartridge would fire a bullet that merely dents a 5/16 inch steel plate while a .32 caliber cartridge with 2½ loads of powder would pierce the plate.

This increased working pressure may be accomplished in conventional cartridges by adding more powder which increases the velocity of the bullet in direct proportion to the percent of weight added. For example, 50 percent more weight in powder would result in 50 percent more bullet velocity. However, the problem with utilizing an increased load is the fact that as the weight and velocity is increased the pressure build up increases twice as fast rendering such a condition unsafe in conventional handguns. It is for this reason that superpowered ammunition cannot be safely fired in conventional handguns as herebefore known.

The micro-precision firing sequence as is made possible by the construction herein disclosed makes it possible to accommodate the increased pressure to have the advantage of the increased bullet velocity. The point is to get the powder in the cartridge to ignite before the barrel bottoms out and then have the ignition complete as the bullet leaves the barrel. To do this, the firing pin must be longer than that conventionally accepted to be safe and this, along with the drop barrel action which has the cartridge and the barrel moving in a rearward direction as the cartridge is discharged, permits the use of cartridges having loads corresponding to those normally considered to be in the rifle class.

Further, rapid burning of the powder in the cartridge is important to get the bullet out in a hurry and thereby minimize excessive pressure build up in the cartridge which can cause damage to the gun and injury to the user. When the floating barrel 28 strikes the firing pin 30 the powder in the cartridge is positioned to the back of the cartridge case 53 because of the inertia thereof which allows the primer fire to lick around the powder and ignite it with greater uniformity from front to back for a rapid build up of pressure and discharge of the bullet before the pressures in the cartridge become excessive.

By way of further explanation, in a conventional gun in which the bullet is stationary the powder is driven to the neck of the case 53 upon impact by the firing pin choking off exit of the gases created and expanding therein until the powder has burned clear. This causes excessive pressures in the cartridge prior to discharge of the bullet.

If, for periods of non-use it is desired to place the gun in its uncocked condition, it is but a simple matter for the user to grasp a laterally extending tab 80 affixed to the sleeve 54 protruding through an extension of the slot 76 in the side of the frame tube 26 to control the rearward shifting of the actuator sleeve 54 and barrel 28 when the trigger assembly 36 is released to permit the barrel to move rearwardly.

If desired, for purposes of safety, special cartridges may be fabricated having an external annular band 110 on the case 53 at the primer cap end. A corresponding countersunk recess 112 is then required in the cartridge chamber 48 to properly receive the band 110. Thus, a user can immediately recognize when he has an improper cartridge.

FIGS. 9 and 10 show alternate details of construction in which the handgun is provided with a frame 122 having a tube 126 provided with a breech plate 132 adapted to threadably receive an adjustable firing pin mount 184 that serves to cooperate with a barrel 128 having a recessed cartridge chamber 148. In this instance, an enlarged rear portion 146 of the barrel with its ring 166 extends rearwardly beyond a firing pin and surrounds a shank 186 of the mount 184 before it seats against a breech block 188. Thus a better seal is provided for the cartridge chamber.

Also shown in FIG. 9 is a further modification of the rear portion 146 of the barrel 128 in which a pair of ports 190 and 192, respectively, are machined through the wall of the barrel at the forward and rearwardmost ends of the chamber 148 and are interconnected by a channel 194 to define a passageway for directing gases from the front of a cartridge case 153 to the rearward area thereof for the purpose of equalizing the pressures on the case upon discharge. The purpose for this being that the pressures are thus more equally distributed throughout the cartridge case and less distortion is likely to occur. The actuator sleeve 154 overlying the channel 194 serves to confine the gases therewithin during passage from port 190 to port 192.

The remaining operation of the gun action is the same as that previously described with the exception that a floating brake assembly 196 is provided for the actuator sleeve 154. A pair of oppositely and laterally extending pins 198 extend into corresponding grooves 200 machined in the inner wall of the tube 126 for exerting a restrictive action on the forward movement of the actuator sleeve 154 upon the expansion of the gases in the cavity 168. This restrictive action is accomplished by the fact that the barrel 128 is provided with a pair of orifices 202 for directing discharge gases against the pins 198 which in turn place a drag on the forward movement of the actuator sleeve 154.

To aid in the extraction of the cartridge case 153 from the recessed chamber 148, a ball-nosed firing pin 130 may be provided which causes a primer cap 204 of the cartridge to collapse thereabout such that the case 153 is held back and prevented from traveling forward with the barrel 128 when the latter returns to its normal cocked position. The mount 184 may be provided with a conventional spring loaded cartridge ejector mechanism 206 for then flipping the spent cartridge 152 out of the tube 126 through a lateral opening 176.

An alternate form of the invention is illustrated in FIG. 7 wherein a low cost survival or flare gun 320 is illustrated in which a frame 322 is provided with a hand grip and an elongate tube 326 having its rearwardmost end closed to present a breech plate 132 having an extra length firing pin 330 as previously described with the preferred embodiment. Located for axial reciprocation along the tube 326 is a barrel 328 having a bore 350 and an enlarged rear portion 346 terminating in an extended stem portion protruding beyond the forward end of the tube 326. A barrel guide and retainer 338 is provided at the distal end of the tube 326 and serves as a stop to limit the forward motion of the barrel 328.

An actuator sleeve 354 is rigidly secured to the stem 344 exteriorly of the tube 346 by way of dowls 308 for holding the sleeve 354 stationary relative to the stem 344. A cartridge chamber 348 is provided at the rearwardmost end of the bore 350 for receiving a cartridge 352 in the same manner as in the previously described embodiment.

Operation of the handgun as shown in FIG. 7 is accomplished by manually inserting the cartridge 352 into the chamber 348 and then holding the handgrip 324 with one hand, firmly grasping the sleeve 354 with the other hand and ramming the barrel rearwardly as shown by the arrow to propel the cartridge 354 into engagement with an overlength firing pin 330 as described in connection with the preferred embodiment. The sequence of events regarding the ignition of the cartridge and the subsequent discharge of a bullet therefrom through the barrel 328 is substantially the same as that earlier described with the exception that there is no automatic return of the actuator sleeve and the discharge gases are all dissipated through the bore 350 of the barrel. However, the advantages of being able to use a rifle load cartridge remains the same and this type of gun is useful in survival conditions in which it may be desirable to have a high powered capability for survival purposes.

A third form of the invention is shown in FIG. 8 wherein a handgun 420 again is provided with a frame 422 having a hand grip 424 and an elongate tube 426 substantially the same as that shown in the initially described embodiment. Here again, the tube 426 is provided with a closed end-defining a breech plate 432 having a firing pin 430 projecting axially into the tube 426, it being understood that firing pin 430 is again of the predetermined extra length.

A barrel 428 is again reciprocably received within the tube 426 and has a longitudinal bore 450 presenting a cartridge chamber 448 at its rearwardmost end. As in the previous forms, the barrel 428 is provided with an enlarged rear portion 446 that terminates in a forwardly extending stem portion 444 extending beyond the forward end of the tube 426. A compression spring 460 is received over the stem 444 and is disposed between the enlarged rear portion 446 and a forward guide or retainer 438.

Actuation of the barrel 428 is accomplished by operation of a trigger assembly 436 having a sear 472 engageable with a notch 474 disposed in the rear portion 446 of the barrel 428 proximal the trigger assembly 436. Thus, the compression spring 460 propels the barrel 428 rearwardly to drive a cartridge 452 into engagement with the firing pin 430 to set off the chain of events as has been previously described. There is no provision made for positively returning the barrel 428 to its cocked condition and this may simply be accomplished by a flicking motion with the wrist in a downward direction which motion causes the barrel 428 to move in the direction of the guide 438 thus compressing the spring 460 and reseating the sear 472 in the notch 474.

In each of the aforementioned modifications it is to be understood that the micro-precision timing of the firing sequence with the cartridge being ignited by the firing pin while the barrel is still in its rearward motion is the same in all instances and therefore permits the use of rifle load cartridges in a handgun.

Having thus described the invention, what is claimed as new and desired to be secured by Letters Patent is:

1. A handgun comprising:

a frame presenting a grip and an elongate tube rigidly secured thereto, said tube being closed at its normally rearwardmost end to present a breech plate;

a stationary firing pin carried by said breech plate for projection into said tube axially thereof;

an axially shiftable barrel disposed within said tube and provided with a cartridge chamber at its rearwardmost end, said barrel being reciprocable between a first position spaced forwardly of said breech plate and a second position seated against said breech plate;

an actuator mechanism being operably coupled with said barrel for propelling the latter rearwardly within said tube from said first position to said second position to carry a cartridge in said chamber into firing engagement with said firing pin, said actuator mechanism including a trigger assembly for normally retaining said actuator mechanism in a cocked condition, said actuator mechanism including a member operably disposed to be released by said trigger assembly and in abutting engagment with said barrel for propelling the same rearwardly from the said first position to said second position when said trigger assembly is actuated; and means for returning said member to said cocked condition upon the firing of the cartridge while said barrel remains in said second position until the gas pressures from the cartridge are dissipated.

2. A handgun as claimed in claim 1 wherein said firing pin is ball-nosed such that a firing cap of said cartridge collapses thereabout for the purpose of aiding in extracting said cartridge from the chamber after firing.

3. A handgun as claimed in claim 2 wherein said member is a sleeve disposed within said tube and through which said barrel is received.

4. A handgun as claimed in claim 3 wherein said member return means is an annular cavity disposed intermediate said barrel and said sleeve member, there further being at least a pair of conduits through the wall of said barrel placing the bore thereof in communication with said cavity.

5. A handgun as claimed in claim 4 wherein said conduits are disposed in a forwardly angled direction.

6. A handgun as claimed in claim 4 wherein said barrel includes an enlarged rear portion containing said cartridge chamber and a stem portion extending forwardly therefrom and beyond said tube, said member being configured to slidably receive said rear portion and further presents a reduced neck section through which said stem portion is slidably received, said cavity being located intermediate said rear portion of the barrel and said neck section of said member, there being abutment means on said barrel for keeping said neck section spaced forwardly of said rear portion of the barrel.

7. A handgun as claimed in claim 6 wherein said abutment means is an external collar surrounding said barrel at its rearwardmost end, said member being in axially abutting engagement with said collar when said actuator mechanism is in said cocked condition for propelling said barrel rearwardly upon actuation of said trigger assembly.

8. A handgun as claimed in claim 4 wherein said member defines a barrel guide and support interiorly of said tube, the distal end of said tube having an annular retainer defining a forward barrel guide, said actuator mechanism further including a spring operably disposed between said retainer and said member for propelling the latter and said barrel in said rearward direction when said trigger assembly is actuated.

9. A handgun as claimed in claim 8 wherein there is provided stop means on said barrel and a second spring operably positioned along said stem portion of said barrel between said stop means and said member for returning said barrel to said first position after said sleeve member has returned to said cocked condition.

10. A handgun as claimed in claim 8 wherein said member is provided with brake means in frictional engagement with said tube for retarding the forward movement of said sleeve member upon the discharge of a cartridge.

11. A handgun as claimed in claim 8 wherein there is provided channel means integral with said rear portion of the barrel which cooperate with said member for directing gases from a discharged cartridge upon the firing thereof to the outer rearwardmost end to provide an external equalizing pressure on the cartridge case to offset the internal pressures therein.

12. In a gas operated handgun of the drop barrel type:

a frame comprised of a fixed, elongate tube in which a barrel is reciprocably carried, said tube being closed at its normally rearwardmost end to present a breech plate having a fixed firing pin positioned to project into said tube axially thereof, said barrel having a cartridge chamber at its normally rearwardmost end;

a trigger operated actuator mechanism coupled with said barrel for propelling the same with a cartridge in the chamber from a position spaced forwardly of said firing pin rearwardly into engagement with said firing pin; and means incorporated with said mechanism for utilizing gases from said cartridge upon discharge thereof for holding said barrel seated against said breech plate until the gas pressure from said cartridge is dissipated, said mechanism further including barrel return means for returning said barrel to said first position upon the dissipation of said gases.

13. In a handgun as claimed in claim 12 wherein said firing pin is of a precise, predetermined length sufficiently long to contact and discharge said cartridge while said barrel is in its rearward motion such that a bullet from the cartridge exits said barrel before the latter completes said rearward movement.

14. In a handgun as claimed in claim 12 wherein said barrel is disposed to receive the cartridge in said chamber prior to actuation of said actuator mechanism such that the cartridge is propelled rearwardly with said barrel upon actuation of said mechanism.

* * * * *